US007993119B2

(12) United States Patent
Kobayashi et al.

(10) Patent No.: US 7,993,119 B2
(45) Date of Patent: Aug. 9, 2011

(54) VANE PUMP AND VAPOR LEAKAGE CHECK SYSTEM HAVING THE SAME

(75) Inventors: Mitsuyuki Kobayashi, Anjo (JP); Hitoshi Amano, Okazaki (JP)

(73) Assignee: Denso Corporation, Kariya (JP)

( * ) Notice: Subject to any disclaimer, the term of this patent is extended or adjusted under 35 U.S.C. 154(b) by 384 days.

(21) Appl. No.: 12/324,981

(22) Filed: Nov. 28, 2008

(65) Prior Publication Data

US 2009/0148329 A1 Jun. 11, 2009

(30) Foreign Application Priority Data

Dec. 5, 2007 (JP) ..... 2007-314875

(51) Int. Cl.
*F03C 2/00* (2006.01)
*F03C 4/00* (2006.01)
*F04C 15/00* (2006.01)

(52) U.S. Cl. ..... 418/133; 418/131; 418/152; 418/259; 418/268; 73/118.1

(58) Field of Classification Search ..... 418/131, 418/133, 152, 153, 259, 266–268; 73/118.1
See application file for complete search history.

(56) References Cited

U.S. PATENT DOCUMENTS

| | | | | |
|---|---|---|---|---|
| 1,780,217 | A * | 11/1930 | Sumner Wiltse | 418/258 |
| 4,050,855 | A * | 9/1977 | Sakamaki et al. | 418/131 |
| 7,234,344 | B2 | 6/2007 | Inagaki et al. | |
| 7,237,432 | B2 * | 7/2007 | Inagaki et al. | 73/118.1 |

FOREIGN PATENT DOCUMENTS

| | | |
|---|---|---|
| JP | 3-32185 | 3/1991 |
| JP | 2000-145655 | 5/2000 |

OTHER PUBLICATIONS

JP 2000-145655 A—the English Translation.*
Japanese Office Action dated Nov. 12, 2009, issued in corresponding Japanese Application No. 2007-314875, with English translation.

* cited by examiner

*Primary Examiner* — Theresa Trieu
(74) *Attorney, Agent, or Firm* — Nixon & Vanderhye PC

(57) ABSTRACT

A vane pump includes a motor, a rotor rotated by the motor, a first casing having a pump chamber accommodating the rotor and a first flat part in a periphery of an opening of the pump chamber, a second casing having a second flat part joined to the first flat part to gas-tightly or liquid-tightly close the opening of the pump chamber, an elastic sheet disposed between the second casing and the motor, and a screw penetrating the first casing, the second casing and the elastic sheet. The screw is configured to fasten and join the first casing, the second casing and the elastic sheet to the motor.

5 Claims, 7 Drawing Sheets

VANE PUMP AND VAPOR LEAKAGE CHECK SYSTEM HAVING THE SAME

CROSS REFERENCE TO RELATED APPLICATION

This application is based on Japanese Patent Application No. 2007-314875 filed on Dec. 5, 2007, the disclosure of which is incorporated herein by reference in its entirety.

BACKGROUND OF THE INVENTION

1. Field of the Invention

The present invention relates to a vane pump and a vapor leakage check system.

2. Description of Related Art

A known vane pump compresses and discharges fluid by rotating a rotor with vanes driven by a motor. For example, JP-A-2005-98285 (corresponding to U.S. Pat. No. 7,234,344) discloses a vapor leakage check system having one such vane pump. The vane pump depressurizes or pressurizes the interior of a fuel tank. Thereby, the system checks leakage of fuel vapor from the fuel tank. A performance of the vane pump is important because the performance of the vane pump has significant influence on a performance of the system.

A conventional vane pump has a pump chamber and a rotor with vanes in the pump chamber. The pump chamber is made of a first casing and a second casing, which are joined to each other and mounted to a mounting portion of the motor by a screw. The rotor with vanes is rotated in the pump chamber to compress and discharge fluid.

An airtightness of the pump chamber of the conventional vane pump, that is, a sealing performance between the first casing and the second casing greatly affects a pump performance (e.g., discharge pressure). For example, when a flatness of a contact face between the first casing and the second casing is low, it may be difficult to make the first casing and the second casing to be in close contact with each other. In this case, a gap may be generated in the contact face between the first casing and the second casing, and fluid may leak from the pump chamber through the gap. Thus, the pump performance may become low.

SUMMARY OF THE INVENTION

In view of the foregoing and other problems, it is an object of the present invention to provide a vane pump having high performance. It is another object of the present invention to provide a vapor leakage check system having such a vane pump.

According to a first example of the present invention, a vane pump includes a motor, a rotor, a first casing, a second casing, an elastic sheet and a screw. The motor has a mounting portion. The rotor has a plurality of vanes, and is rotated by the motor. The first casing has a pump chamber accommodating the rotor to be rotatable, and the pump chamber has an inner circumference wall on which the vane slides to suck and discharge fluid. The first casing has a first flat part in a periphery of an opening of the pump chamber. The second casing has a second flat part joined to the first flat part to gas-tightly or liquid-tightly close the opening of the pump chamber to define the pump chamber. The elastic sheet is disposed between the second casing and the mounting portion of the motor. The screw penetrates a first through hole of the first casing, a second through hole of the second casing and a third through hole of the elastic sheet. The screw is configured to fasten and join the first casing, the second casing and the elastic sheet to the mounting portion of the motor.

Accordingly, airtightness of the pump chamber can be increased such that pump performance of the vane pump can be improved.

According to a second example of the present invention, a vapor leakage check system has the vane pump. The fluid is fuel from a fuel tank. The vane pump is configured to depressurize or pressurize an interior of the fuel tank so as to check leakage of vapor of the fuel from the fuel tank.

Accordingly, the check system can have high performance.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENT

First Embodiment

Figure 1:
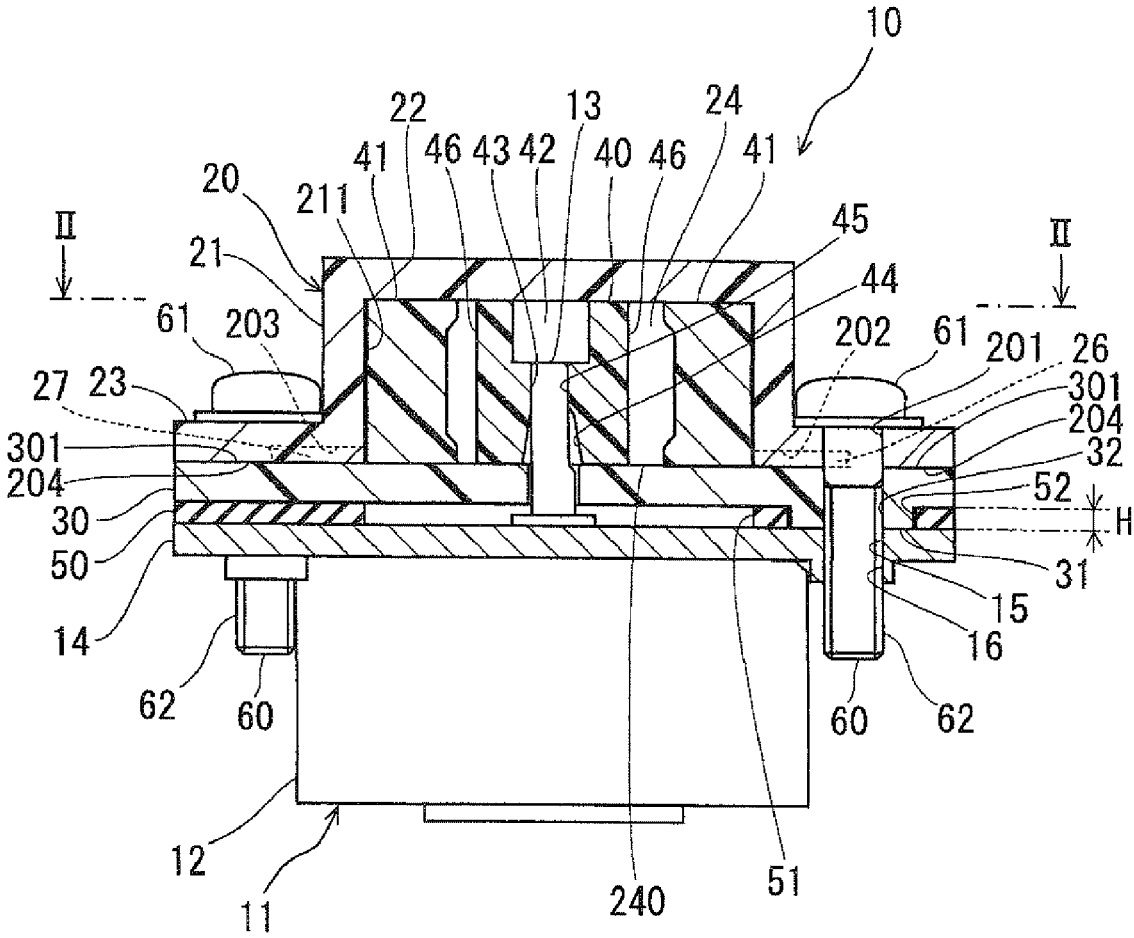
FIG. 1 is a cross sectional view of a vane pump according to a first embodiment of the present invention.
Figure 2:
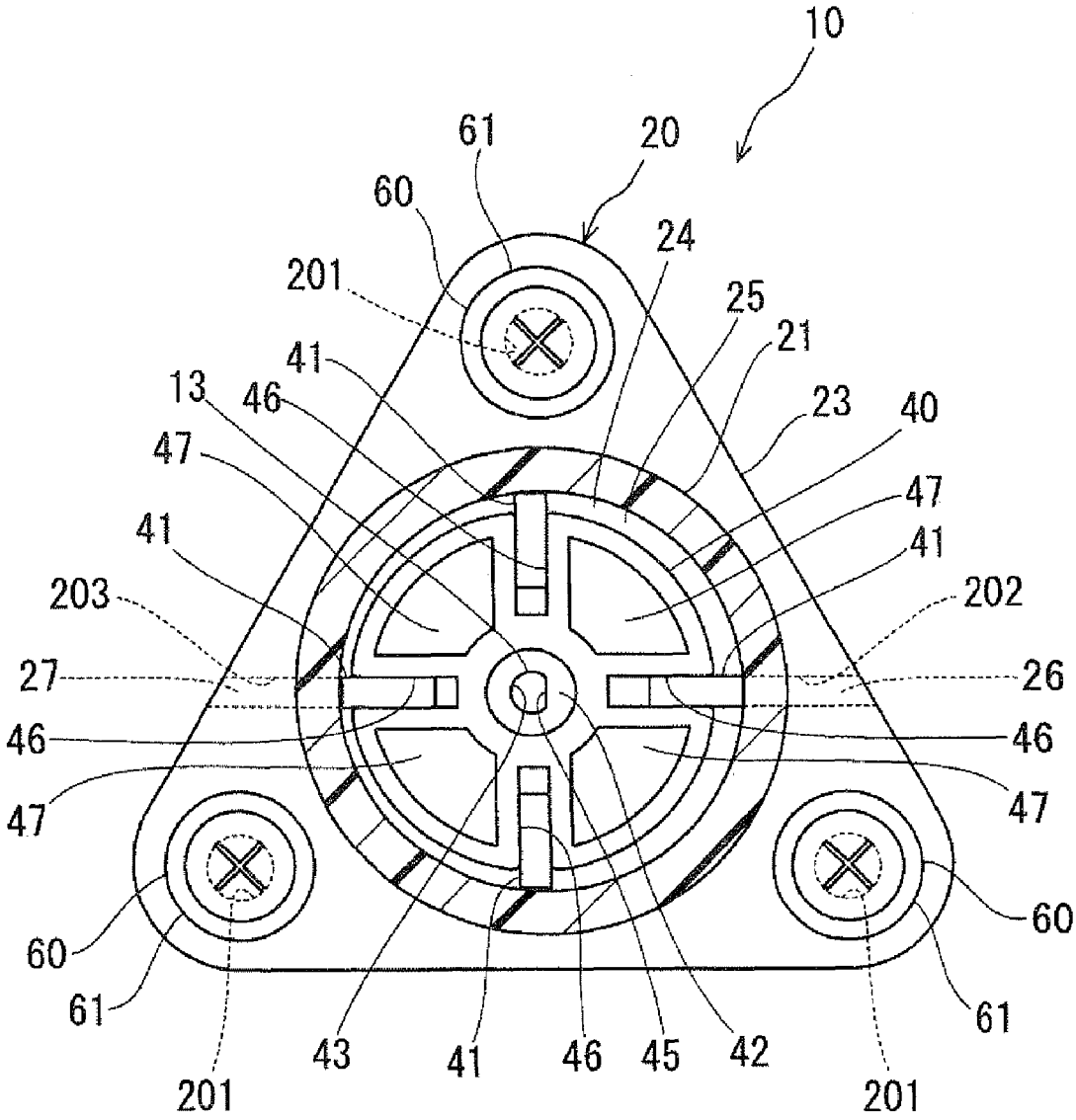
FIG. 2 is a cross sectional view along line II-II in FIG. 1.

A vane pump 10 shown in FIG. 1 and FIG. 2 compresses fluid, and discharges the compressed fluid. For example, the fluid is gas (e.g., air) or liquid (e.g., water).

The vane pump 10 includes a first casing 20, a second casing 30, a rotor 40, a vane 41, an elastic sheet 50 and a motor 11. The rotor 40 of the vane pump 10 is driven to rotate by the motor 11. The second casing 30 and the elastic sheet 50 are disposed between the rotor 40 and the motor 11. A direct-current electric motor or an alternating-current electric motor is used as the motor 11, for example. The motor 11 includes a cover 12, a shaft 13 and a mounting portion 14. The cover 12 accommodates a stator (not shown). The shaft 13 rotates with a movable part (not shown). The first casing 20, the second casing 30 and the elastic sheet 50 are mounted to the mounting portion 14 of the motor 11. The mounting portion 14 may be separately secured to the motor 11, or the mounting portion 14 may be integrally manufactured with the cover 12, for example.

The first casing 20 includes a cylinder part 21, a board part 22 and a flange 23, which are integrally made of resin, for example. The cylinder part 21 has an approximately cylindrical shape, and accommodates the rotor 40 at an inner circumference side of the cylinder part 21. An inner circumference wall 211 of the cylinder part 21 has an approximately cylindrical inner surface shape. A first end of the cylinder part 21 in an axial direction is sealed by the board part 22, and the flange 23 is formed at a second end of the cylinder part 21. The flange 23 extends outward in a radial direction of the cylinder part 21, and has a first flat part 204 at a side opposite to the board part 22 of the first casing 20. That is, the first flat part 204 of the flange 23 of the first casing 20 faces the second casing 30.

The second casing 30 has a board shape, and is made of resin, for example. The second casing 30 has a second flat part 3011 which faces the first casing 20. The second flat part 301 is air-tightly and liquid-tightly joined to the first flat part 204. The second flat part 301 covers an end of the cylinder part 21 at a side of the motor 11. Thereby, a pump chamber 24 is defined in the interior of the cylinder part 21. The pump chamber 24 is closed by the cylinder part 211 the board part 22 and the second casing 30. That is, an opening part 240 of the pump chamber 24 of the first casing 20 is sealed by the second casing 30.

The pump chamber 24 accommodates the rotor 40 to be rotatable. Thereby, a clearance space 25 (see FIG. 2) surrounded by the cylinder part 21, the board part 22, the second casing 30 and the rotor 40 is defined. The rotor 40 is disposed to be eccentric to the inner circumference wall 211 of the cylinder part 21. Therefore, a volume of the clearance space 25 between the cylinder part 21 and the rotor 40 changes in a circumferential direction. Each of a fluid inlet passage 26 and a fluid outlet passage 27 communicates with the clearance space 25, and extends outward in the radial direction from the clearance space 25. The fluid inlet passage 26 is defined between a groove 202 of the flange 23 and the second casing 30. The fluid outlet passage 27 is defined between a groove 203 of the flange 23 and the second casing 30.

The rotor 40 has an approximately cylindrical shape. The rotor 40 has a recess 42 and a center hole 43 in a center. The recess 42 extends from a side end of the board part 22 in an axial direction of the rotor 40 to be a relief for the rotor 40. The center hole 43 penetrates the rotor 40 in a thickness direction toward the second casing 30, and communicates with the recess 42. The center hole 43 has a taper part 44 having a taper shape. A diameter of the taper part 44 gradually decreases from an end facing the second casing 30 in the axial direction, as shown in FIG. 1. Further, the center hole 43 has a noncircular part 45 having a noncircular shape, as shown in FIG. 2. The noncircular part 45 extends from an end facing the recess 42 in the axial direction. The shaft 13 of the motor 11 is inserted into the center hole 43.

When the shaft 13 is inserted in the center hole 43 of the rotor 40, the shaft 13 is guided by the taper part 44 to be fitted in the noncircular part 45. A cross sectional shape of the shaft 13 is approximately the same as a cross sectional shape of the noncircular part 45. Therefore, the shaft 13 is fitted to the rotor 40 in a state corresponding to the shape of the noncircular part 45. Thereby, when the shaft 13 is rotated, the rotor 40 can also be rotated. That is, the rotor 40 rotates with the shaft 13. Alternatively, the center hole 43 may have a cylindrical shape, and the shaft 13 may be pressed into the center hole 43. Further, the shaft 13 may be pressed into a boss set in the center hole 43.

The rotor 40 has a vane accommodation trench 46, which extends from an outer circumference wall of the rotor 40 inward in the radial direction, as shown in FIG. 2. As shown in FIG. 1, the vane accommodation trench 46 extends between end faces of the rotor 40 in the axial direction, in which one end face faces the second casing 30 and another end face faces the board part 22 of the first casing 20. In this embodiment, four of the vane accommodation trenches 46, which are equally spaced, are set in a circumferential direction of the rotor 40. Each vane accommodation trench 46 accommodates the vane 41. The rotor 40 is disposed to be eccentric to the inner circumference wall 211 of the cylinder part 21. Therefore, when the rotor 40 is rotated, a dimension between the rotor 40 and the inner circumference wall 211 of the cylinder part 21 changes. When the rotor 40 is rotated, the vane 41 moves outward in the radial direction to be contact with the inner circumference wall 211 due to centrifugal force. As the dimension between the rotor 40 and the inner circumference wall 211 of the cylinder part 21 decreases, the vane 41 is pushed into the vane accommodation trench 46 inward in the radial direction. Thereby, when the rotor 40 is rotated, the vane 41 is rotated in a state that an outer end of the vane 41 in the radial direction is in contact with the inner circumference wall 211 of the cylinder part 21, and that the vane 41 moves inward and outward in the radial direction along the vane accommodation trench 46.

As shown in FIG. 2, a recess 47 is defined as a relief of the rotor 40 between the vane accommodation trenches 46. The recess 47 has an approximately fan shape shown in FIG. 2. The recess 47 is recessed from an end of the rotor 40 facing the board part 22 in the axial direction of the rotor 40. The number of the vanes 41, the vane accommodation trenches 46 or the recesses 47 is not limited to four. The number of the vanes 41, the vane accommodation trenches 46 or the recesses 47 may be one or more. Further, the shape of the recess 47 is not limited to the fan. The recess 47 may have any shape without departing from the scope of the present disclosure. Furthermore, the recess 47 may be recessed from another end of the rotor 40 facing the second casing 30 in the axial direction.

The flange 23 of the first casing 20 has a first through hole 201. The flange 23 in this embodiment has three of the holes 201. The second casing 30 has a protrusion 31 protruding toward the motor 11 at a position corresponding to the hole 201 of the first casing 20. The protrusion 31 has a second through hole 32 therein at an approximately center of the protrusion 31, and the hole 32 penetrates the second casing 30 in the thickness direction. A position of the second through hole 32 corresponds to a position of the first through hole 201. A protruding dimension H of the protrusion 31 shown in FIG. 1 is smaller than a thickness of the elastic sheet 50.

Figure 3:
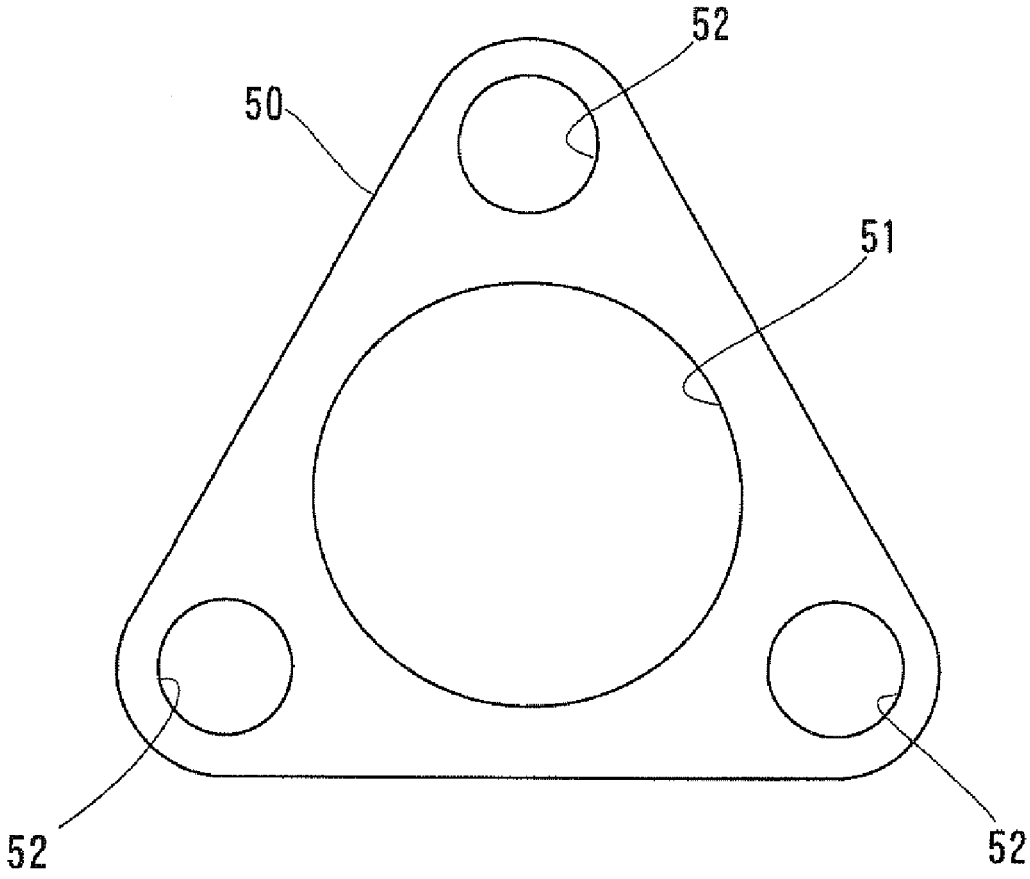
FIG. 3 is a schematic view of an elastic sheet of the vane pump.

The elastic sheet 50 is disposed between the second casing 30 and the mounting portion 14 of the motor 11. The elastic sheet 50 is made of a material having elasticity and a large attenuation coefficient. For example, the elastic sheet 50 is made of rubber, and has a board shape. As shown in FIG. 3, the elastic sheet 50 has a through hole 51 penetrating the elastic sheet 50 in the thickness direction at an approximately center of the elastic sheet 50. The hole 51 has an inner diameter set to be approximately equal to a diameter of the pump chamber 24. Thereby, the elastic sheet 50 has a shape corresponding to a shape of the first flat part 204 of the first casing 20.

The elastic sheet 50 has a third through hole 52 at a position corresponding a position of the protrusion 31 of the second casing 30. An inner diameter of the hole 52 is set to be approximately equal to or slightly larger than the outer diameter of the protrusion 31.

As shown in FIG. 1, a screw 60 has a head 61 at a first end of the screw 60, and a male thread 62 extending from a second end of the screw 60 in the axial direction. The mounting portion 14 of the motor 11 has a mount hole 15 made of metal, for example. A position of the mount hole 15 corresponds to a position of the first through hole 201 of the first casing 20. An inner wall of the mount hole 15 of the mounting portion 14 has a female thread 16 corresponding to the male thread 62 of the screw 60.

The screw 60 is secured to the mounting portion 14 at the mount hole 15 through the first through hole 201 of the first casing 20, the second through hole 32 of the second casing 30 and the third through hole 52 of the elastic sheet 50. Thereby, the first casing 20, the second casing 30 and the elastic sheet 50 are fastened and joined to the mounting portion 14 by being sandwiched between the head 61 of the screw 60 and the mounting portion 14. At this time, an axial force is generated between the head 61 of the screw 60 and the mounting portion 14. Therefore, the elastic sheet 50 is compressed in the axial direction because the second casing 30 and the mounting portion 14 press the elastic sheet 50 therebetween. Thereby, a reactive force is generated to the elastic sheet 50, and a surface pressure is generated from the elastic sheet 50 to the second casing 30 toward the first casing 20. As a result, the second flat part 301 of the second casing 30 is deformed to correspond to the surface shape of the first flat part 204 of the first casing 20. Accordingly, the second flat part 301 of the second casing 30 is tightly joined to the first flat part 204 of the first casing 20.

The protrusion 31 of the second casing 30 penetrates the through hole 52 of the elastic sheet 50, and is in contact with the mounting portion 14. The protruding dimension H of the protrusion 31 is smaller than the thickness of the elastic sheet 50. Therefore, when the protrusion 31 is in contact with the mounting portion 14, the elastic sheet 50 is compressed between the second casing 30 and the mounting portion 14. Thereby, the second casing 30 receives the surface pressure due to the reactive force of the elastic sheet 50, and a dimension between the mounting portion 14 and the second casing 30 can be kept uniform. That is, the protruding dimension H of the protrusion 31 can be kept constant.

Next, an operation of the vane pump 10 will be described. When the motor 11 is rotated, the rotor 40 connected to the shaft 13 of the motor 11 is rotated. When the rotor 40 is rotated, the vane 41 is rotated with the rotor 40 in a state that the vane 41 is in contact with the inner circumference wall 211 of the cylinder part 21. A volume of the clearance space 25 decreases in the rotate direction from a side of the fluid inlet passage 26 to a side of the fluid outlet passage 27. Therefore, when the vane 41 is rotated with the rotor 40, fluid in the clearance space 25 is compressed to flow from the fluid inlet passage 26 to the fluid outlet passage 27. Thereby, fluid sucked from the fluid inlet passage 26 is compressed inside of the clearance space 25 by the rotating vane 41, and the compressed fluid is discharged outside of the vane pump 10 through the fluid outlet passage 27. Due to the rotation of the rotor 40, fluid is continuously compressed.

In the first embodiment, the pump chamber 24 formed between the first casing 20 and the second casing 30 accommodates the rotor 40 to be rotatable. The first casing 20, the second casing 30 and the elastic sheet 50 are fastened and connected to the mounting portion 14 by the screw 60. Therefore, the first casing 20, the second casing 30 and the elastic sheet 50 are sandwiched between the head 61 of the screw 60 and the mounting portion 14, and an axial force is generated between the head 61 and the mounting portion 14. Thereby, the elastic sheet 50 is compressed, and a surface pressure is generated to the second casing 30 toward the first casing 20 due to the reactive force of the elastic sheet 50. As a result, the second flat part 301 of the second casing 30 is deformed to correspond to a surface shape of the first flat part 204 of the first casing 20. Thus, the second flat part 301 of the second casing 30 is in a close contact with the first flat part 204 of the first casing 20. Accordingly, a sealing property between the first casing 20 and the second casing 30, that is, an airtightness of the pump chamber 24 can be increased. That is, the pump performance can be increased. For example, a discharge pressure, a discharge efficiency or a discharge stability can be improved.

Further, the elastic sheet 50 has the through hole 51 having an inner diameter approximately equal to a diameter of the pump chamber 24 at a center. That is, the elastic sheet 50 has a shape corresponding to a shape of the first flat part 204 of the first casing 20. Thereby, only a part of the second casing 30 in contact with the first casing 20 is deformed to be in a close contact with the first casing 20 due to the surface pressure from the elastic sheet 50. In contrast, another part of the second casing 30 in contact with the pump chamber 24 is not deformed. Accordingly, a time-lapse deformation and a time-lapse volume change of the pump chamber 24 can be reduced.

Furthermore, the second casing 30 has the protrusion 31 protruding toward the motor 11 at a position corresponding to the through hole 201 of the first casing 20. The protruding dimension H of the protrusion 31 is smaller than the thickness of the elastic sheet 50. Therefore, when the second casing 30 receives the surface pressure due to the reactive force of the elastic sheet 50, the dimension between the second casing 30 and the mounting portion 14 can be kept stable. That is, the dimension between the second casing 30 and the mounting portion 14 is kept to be approximately equal to the protruding dimension H of the protrusion 31. Moreover, because the dimension between the second casing 30 and the mounting portion 14 is kept stable, the surface 30 pressure added from the elastic sheet 50 to the second casing 30 can be kept uniform and constant.

The protrusion 31 has the through hole 32, and the screw 60 is secured to the mounting portion 14 through the through hole 32. Therefore, an axial force generated between the head 61 of the screw 60 and the mounting portion 14 acts a contact face between the protrusion 31 and the mounting portion 14. Thereby, an interval between the second casing 30 and the mounting portion 14 can be more stably kept constant. Further, when the vane pump 10 is operated, vibration and operation noise can be reduced, because the elastic sheet 50 is disposed between the pump chamber 24 and the motor 11.

Figure 4:
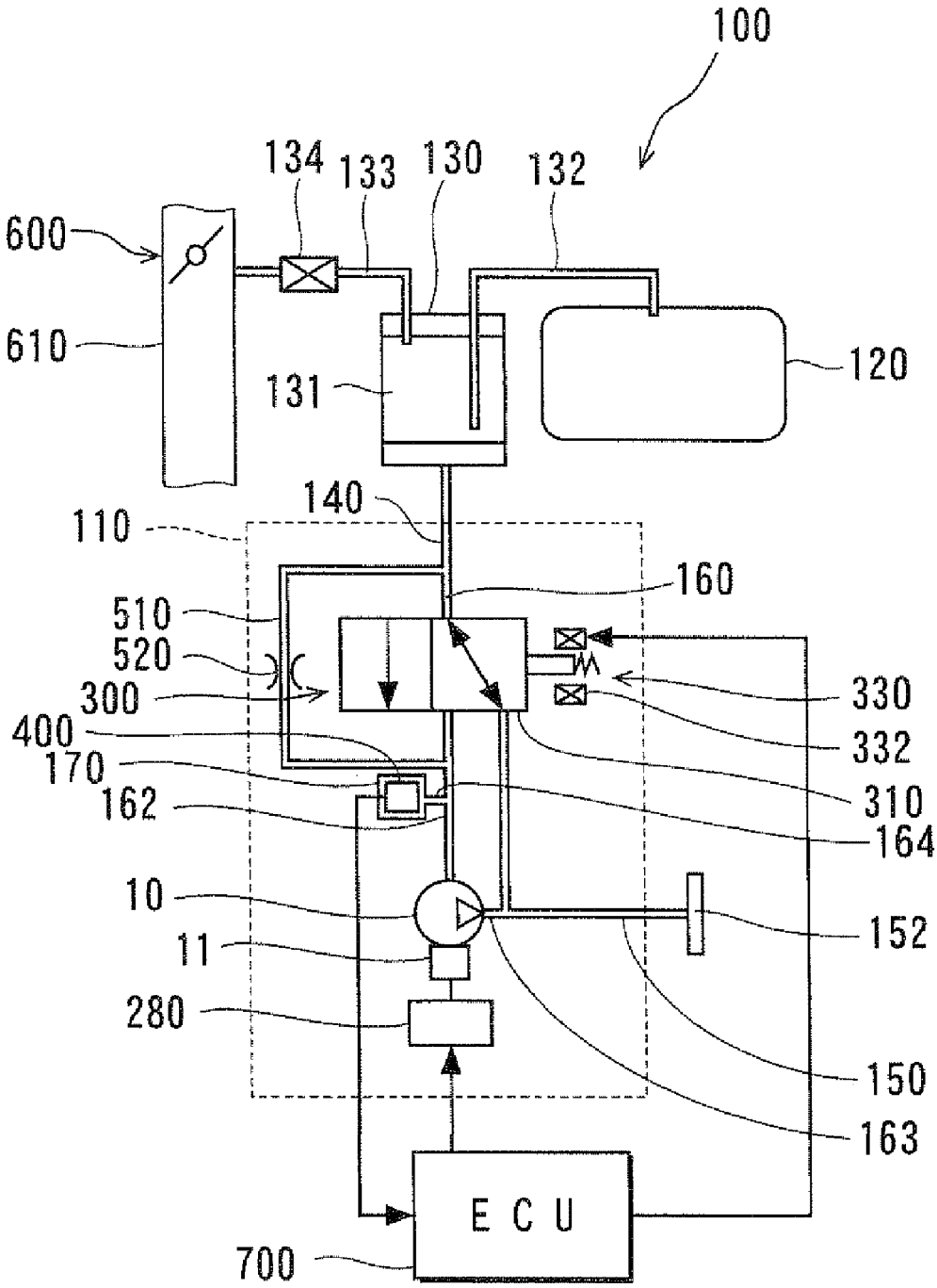
FIG. 4 is a schematic view of a vapor leakage check system in which the vane pump is installed.

Next, a vapor leakage check system 100 having the vane pump 10 will be described with reference to FIG. 4. The check system 100 includes a check module 110, a fuel tank 120, a canister 130, an air intake apparatus 600 and an ECU 700. The check module 110 includes the vane pump 10, the motor 11, a switching valve 300 and a pressure sensor 400. The switching valve 300 and the canister 130 are connected by a canister passage 140. An atmosphere passage 150 has an open end 152 opening to outside, which is located on a side opposite from the check module 110. The canister passage 140 and the atmosphere passage 150 are connected by a connection passage 160. The connection passage 160 and the fluid inlet passage 26 of the vane pump 10 are connected by a pump passage 162. The fluid outlet passage 27 of the vane pump 10 and the atmosphere passage 150 are connected by a discharge passage 163. A pressure communicating passage 164 branches from the pump passage 162, and connects the pump passage 162 and a sensor chamber 170. The pressure sensor 400 is disposed in the sensor chamber 170. Thereby, the sensor chamber 170 has a pressure approximately equal to a pressure in the pressure communicating passage 164 and the pump passage 162.

An orifice passage 510 branches from the canister passage 140, and connects the canister passage 140 and the pump passage 162. An orifice 520 is disposed in the orifice passage 510. An inner diameter of the orifice 520 corresponds to an opening diameter allowing leakage of air that includes fuel vapor generated in the fuel tank 120.

The switching valve 300 includes a valve body 310 and a drive unit 330. The valve body 310 is driven by the drive unit 330. The drive unit 330 includes a coil 332 connected to the ECU 700. Power supply to the coil 332 is enabled or disabled by the ECU 700. When electric current is not supplied to the coil 332, the connection passage 160 and the pump passage 162 are disconnected, and the canister passage 140 and the atmosphere passage 150 are connected through the connection passage 160. When electric current is supplied to the coil 332, the canister passage 140 and the pump passage 162 are connected, and the canister passage 140 and the atmosphere passage 150 are disconnected. The orifice passage 510 and the pump passage 162 are always connected regardless of the electric current.

The canister 130 includes an adsorbent 131 (e.g., active carbon), and is disposed between the check module 110 and the fuel tank 120. The fuel vapor generated in the fuel tank 120 is adsorbed by the adsorbent 131 of the canister 130. The canister 130 is connected to the check module 110 through the canister passage 140, and is connected to the fuel tank 120 through a tank passage 132. Further, a purge passage 133 communicating with an air intake tube 610 of the air intake apparatus 600 is connected to the canister 130. The fuel vapor generated in the fuel tank 120 is adsorbed by the adsorbent 131 after passing through the tank passage 132. A purge valve 134 is disposed in the purge passage 133 connecting the canister 130 and the air intake tube 610 of the air intake apparatus 600. The purge valve 134 opens or closes the purge passage 133 based on a command transmitted from the ECU 700.

The pressure sensor 400 measures a pressure in the sensor chamber 170, and outputs a signal corresponding to the measured pressure to the ECU 700. The ECU 700 has a microcomputer including a CPU, a ROM and a RAM (not shown). Various signals are supplied to the ECU 700 from the pressure sensor 400 and also from sensors of the various corresponding parts of a vehicle. The ECU 700 controls the various corresponding parts of the vehicle based on the various signals on execution of a predetermined control program stored in the ROM.

While the engine is operated and while a predetermined time period elapses from the time of stopping the engine, electric current is not supplied to the coil 332, such that the canister passage 140 and the atmosphere passage 150 communicate with each other through the connection passage 160. Thus, air including fuel vapor generated in the fuel tank 120 passes through the canister 130, in which the fuel vapor is removed from the air. Then, the air, from which the fuel vapor is removed by the canister 130, is released to the atmosphere through the open end 152 of the atmosphere passage 150.

When the predetermined time period elapses from the time of stopping the engine, check operation is started. An atmospheric pressure is measured to correct error due to an altitude of a location, at which the vehicle is currently stopped. The measurement of the atmospheric pressure is performed by the pressure sensor 400 disposed in the sensor chamber 170. When electric current is not supplied to the coil 332, the pump passage 162 communicates with the atmosphere passage 150 through the orifice passage 510. Therefore, a pressure in the sensor chamber 170 communicating with the pump passage 162 through the pressure communicating passage 164 is approximately equal to the atmospheric pressure. That is, the atmospheric pressure can be measured by the pressure sensor 400 in the sensor chamber 170.

When the measurement of the atmospheric pressure is completed, the altitude of the location, at which the vehicle is currently stopped, is calculated by the ECU 700 based on the measured atmospheric pressure. Then, the ECU 700 corrects various parameters based on the calculated altitude. When the corrections are completed, electric current is started to supply to the coil 332 of the switching valve 300. When electric current is supplied to the coil 332, the switching valve 300 is moved rightward in FIG. 4. Thereby, the switching valve 300 disconnects the atmosphere passage 150 and the canister passage 140, and connects the canister passage 140 and the pump passage 162. Therefore, the sensor chamber 170 connected to the pump chamber 162 communicates with the fuel tank 120 through the canister 130. When fuel vapor is generated inside of the fuel tank 120, the pressure inside of the fuel tank 120 is higher than the pressure around the vehicle (i.e., the atmospheric pressure).

When an increase in the pressure of the fuel tank 120 is sensed, supply of electric current to the coil 332 of the switching valve 300 is stopped. At this time, the pump passage 162 communicates with each of the canister passage 140 and the atmosphere passage 150 through the orifice passage 520. Further, the canister passage 140 and the atmosphere passage 150 communicate with each other through the connection passage 160.

Here, electric current is supplied to the motor 11 to drive the vane pump 10, and the pump passage 162 is depressurized. Thus, air entering from the atmosphere passage 150 flows into the pump passage 162 through the orifice passage 510. The pressure in the pump passage 162 becomes low, because air flow entering the pump passage 162 is reduced by the orifice 520 in the orifice passage 510. The pressure in the pump passage 162 becomes constant after being lowered to a predetermined pressure corresponding to an opening area of the orifice 50. At this time, the measured pressure in the pump passage 162 is recorded as a reference pressure. When the measurement of the reference pressure is completed, the supply of electric current to the motor 11 is stopped.

When the reference pressure is measured, the supply of the electric current to the coil 332 of the switching valve 300 is restarted. Thereby, the atmosphere passage 150 and the canister passage 140 are disconnected, and the canister passage 140 and the pump passage 162 are connected. Therefore, because the fuel tank 120 communicates with the pump passage 162, the pressure in the pump passage 162 becomes approximately equal to the pressure in the fuel tank 120. Then, when electric current is supplied to the motor 11, the vane pump 10 is started. Due to the operation of the vane pump 10, the interior of the fuel tank 120 is depressurized. At this time, because the pump passage 162 communicates with the fuel tank 120, the pressure measured by the pressure sensor 400 in the sensor chamber 170 communicating with the pump passage 162 is approximately equal to the pressure inside of the fuel tank 120.

When the pressure of the sensor chamber 170 (i.e., the pressure of the fuel tank 120) decreases below the reference pressure due to the operation of the vane pump 10, it is determined that leakage of the air including the fuel vapor from the fuel tank 120 is within an allowable range. That is, when the pressure of the fuel tank 120 decreases below the reference pressure, air intrusion from the outside into the fuel tank 120 does not exist, or the air intruding from the outside into the fuel tank 120 is equal to or below a flow rate of the air passing through the orifice 520. Thus, it is determined that the sufficient airtightness of the fuel tank 120 is achieved.

In contrast, when the pressure of the fuel tank 120 does not decrease to the reference pressure, it is determined that leakage of the air including the fuel vapor from the fuel tank 120 exceeds the allowable range. That is, when the pressure of the fuel tank 120 does not decrease to the reference pressure, it is assumed that air is introduced into the fuel tank 120 from the outside, due to the depressurization of the interior of the fuel tank 120. Thus, it is determined that the sufficient airtightness of the fuel tank 120 is not achieved.

When the check of the leakage of the air including the fuel vapor is completed, the supply of the electric current to the motor 11 and the switching valve 300 is stopped. The ECU 700 stops the supply of electric current to the pressure sensor 400 after the ECU 700 confirms that the pressure of the pump passage 162 is returned to the atmospheric pressure. Thus, the ECU 700 ends the entire check process.

As described above, the pump chamber 24 of the vane pump 10 has high airtightness, and the vane pump 10 in the first embodiment has high pump performance (e.g., discharge pressure). Therefore, when the vane pump 10 in the first embodiment is used in the check system 100, the vane pump having high pump performance can be used for depressurizing or pressurizing the interior of the fuel tank 120. Accordingly, desired check performance can be easily provided by the check system 100.

Second Embodiment

Figure 5:
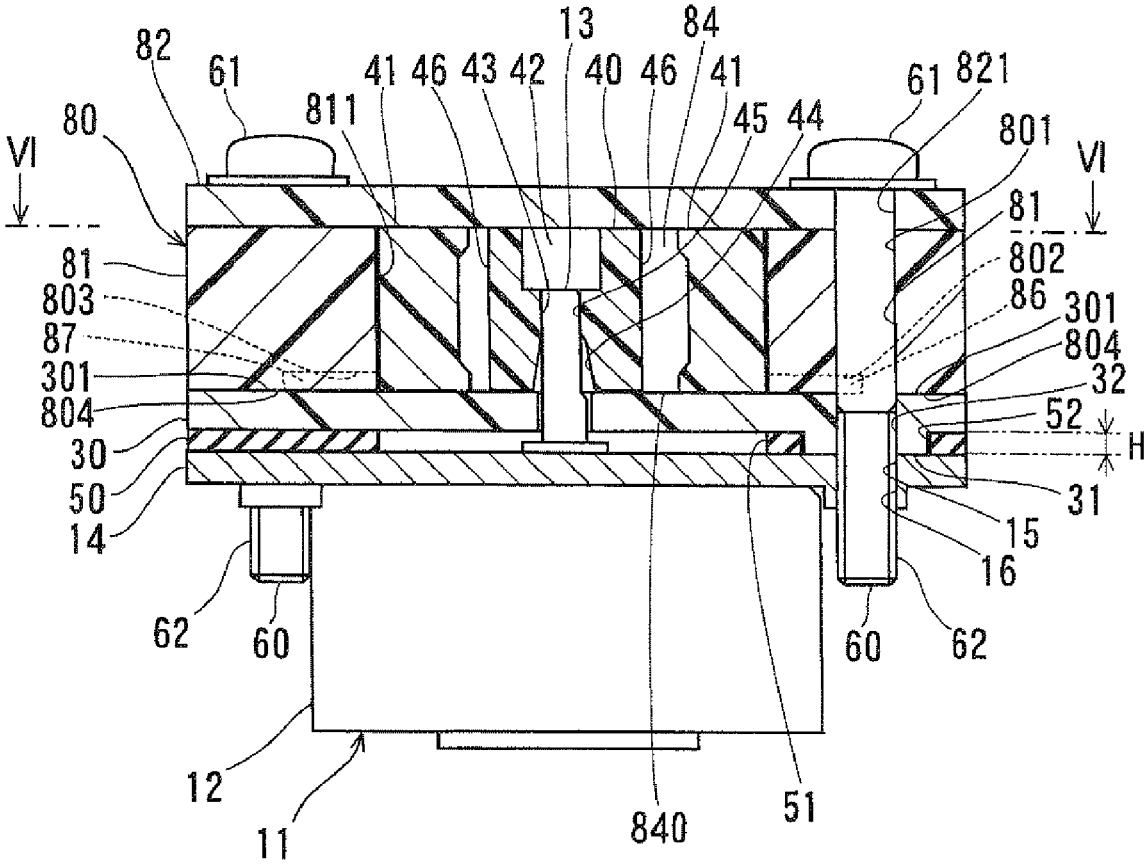
FIG. 5 is a cross sectional view of a vane pump according to a second embodiment of the present invention.
Figure 6:
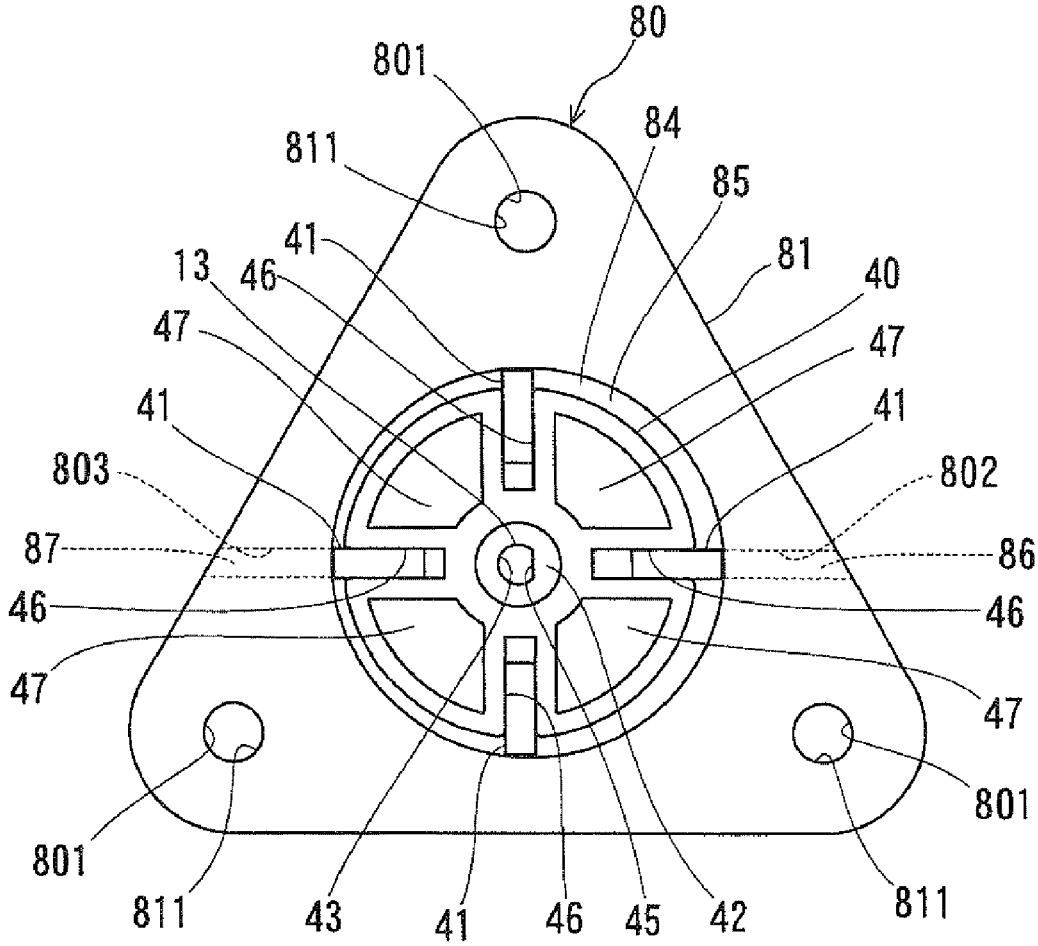
FIG. 6 is a cross sectional view along line VI-VI in FIG. 5.

A vane pump in a second embodiment will be described with reference to FIG. 5 and FIG. 6. For example, a shape of a component constructing a first casing 80 in the second embodiment is different from the first casing 20 in the first embodiment. In the second embodiment, the first casing 80 is constructed by a tube part 81 and a board part 82. The tube part 81 is made of resin, for example, and has an inner circumference wall 811 having an approximately cylindrical surface shape. The board part 82 is made of resin, for example. The board part 82 is air-tightly and liquid-tightly joined to the tube part 81, and covers a first end of the tube part 81 in the axial direction. A second end of the tube part 81, which is opposite from the board part 82, has a first flat part 804.

A second casing 30 has a second flat part 301, which faces the first casing 80, similar to the first embodiment. The second flat part 301 is air-tightly and liquid-tightly joined to the first flat part 804 of the tube part 81, and covers the second end of the tube part 81, which is opposite from the board part 82. Thereby, a pump chamber 84 surrounded by the second casing 30, the tube part 81 and the board part 82 of the first casing 80 is formed at an inner circumference side of the tube part 81. That is, an opening 840 of the pump chamber 84 of the first casing 80 is closed by the second casing 30.

A rotor 40 is disposed in the pump chamber 84 to be rotatable. Thereby, a clearance space 85 surrounded by the second casing 30, the rotor 40, the tube part 81 and the board part 82 of the first casing 80 is formed. The rotor 40 is disposed to be eccentric to the inner circumference wall 811 of the tube part 81. Therefore, a volume of the clearance space 85 changes in the circumferential direction. Each of a fluid inlet passage 86 and a fluid outlet passage 87 communicates with the clearance space 85, and extends outward in the radial direction from the clearance space 85. The fluid inlet passage 86 is formed between a groove 802 of the tube part 81 and the second casing 30. The fluid outlet passage 87 is formed between a groove 803 of the tube part 81 and the second casing 30.

The first casing 80 has a first through hole 801, which is constructed by a through hole 811 of the tube part 81 and a through hole 821 of the board part 82. A screw 60 is secured to a mount hole 15 of a mounting portion 14 of the motor 11 through the first through hole 801 of the first casing 80, the second through hole 32 of the second casing 30 and the third through hole 52 of the elastic sheet 50. Thereby, the first casing 80, the second casing 30 and the elastic sheet 50 are fastened and joined to the mounting portion 14 by being sandwiched between the head 61 of the screw 60 and the mounting portion 14. Therefore, similar to the first embodiment, the elastic sheet 50 is compressed in the axial direction because the second casing 30 and the mounting portion 14 press the elastic sheet 50 therebetween. Thereby, a reactive force is generated to the elastic sheet 50, and a surface pressure is generated from the elastic sheet 50 to the second casing 30 toward the first casing 80. As a result, the second flat part 301 of the second casing 30 is deformed to correspond to the surface shape of the first flat part 804 of the first casing 80. Accordingly, the second flat part 301 of the second casing 30 is tightly joined to the first flat part 804 of the first casing 80. Thus, a sealing property between the first casing 80 and the second casing 30, that is, an airtightness of the pump chamber 84 can be increased. That is, the pump performance (e.g., the discharge pressure) can be increased.

Third Embodiment

Figure 7:
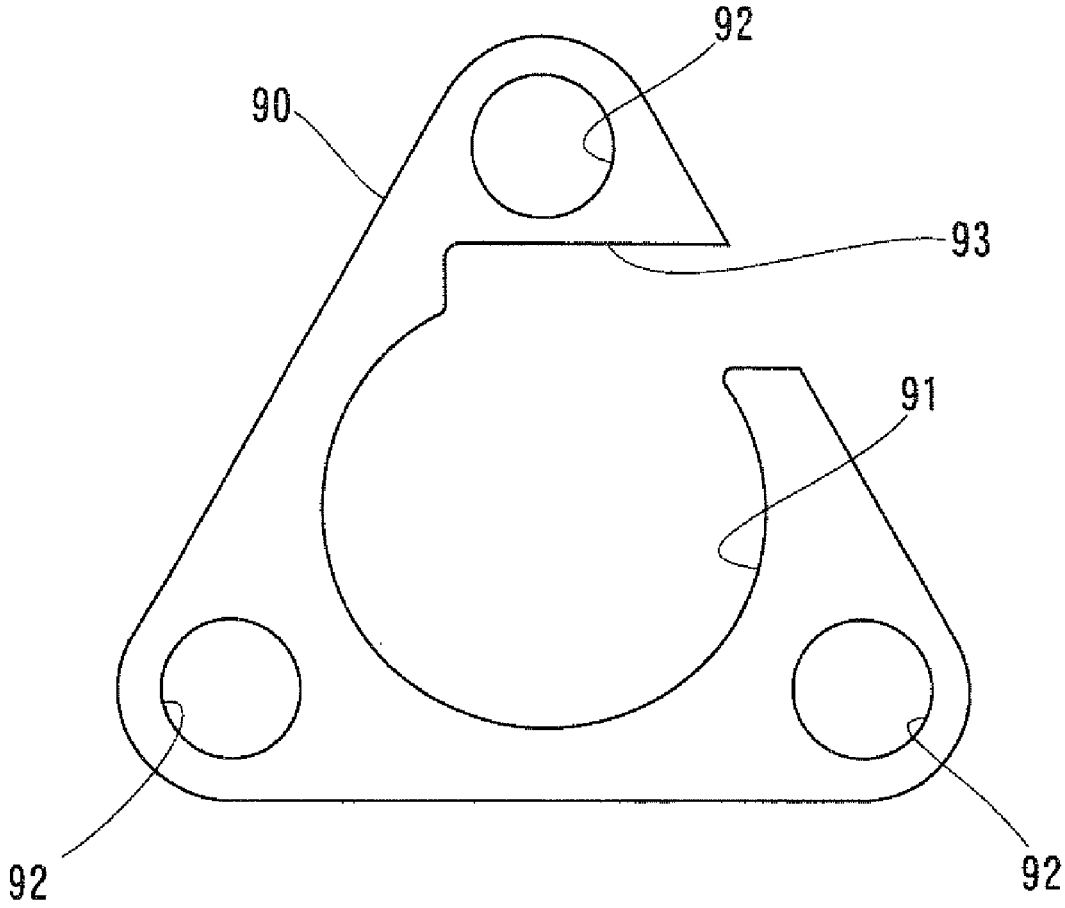
FIG. 7 is a schematic view of an elastic sheet of a vane pump according to a third embodiment of the present invention.

The elastic sheet 50 has the through hole 51 at the center, and has the shape corresponding to the shape of the flat part of the first casing 20, 80 in the first and second embodiments. In a third embodiment, as shown in FIG. 7, an elastic sheet 90 has a through hole 91 and a notch 93 connecting the through hole 91 and an outer edge of the elastic sheet 90. In this case, a through hole connecting the notch 93 and the pump chamber 24, 84 is formed in the second casing 30 to be a part of the fluid inlet passage 26, 86 or the fluid outlet passage 27, 87. Thereby, airtightness of the pump chamber 24, 84 can be increased due to the reactive force of the elastic sheet 90, and the fluid inlet passage 26, 86 or the fluid outlet passage 27, 87 can be arranged in the notch 93, which is not between the first casing 20, 80 and the second casing 30.

The shape of the outer edge of the first casing 20, 80, the second casing 30, the elastic sheet 50, 90 and the mounting portion 14 is an approximately triangle. Alternatively, the shape of the outer edge of those may be a circle or a square. That is, the outer edge of those may be of any suitable shape without departing from the scope of the present disclosure.

Further, the number of the screws 60 for securing the first casing 20, 80, the second casing 30 and the elastic sheet 50, 90 is not limited to three. The number of the screws 60 may be any without departing from the scope of the present disclosure.

The inner circumference wall 211 of the cylinder part 21 in the first embodiment and the inner circumference wall 811 of the tube part 81 in the second embodiment have the cylindrical shape. Alternatively, the inner circumference wall 211, 811 of the first casing 20, 80 may have an oval tube shape. The inner circumference wall 211, 811 of the first casing 20, 80 may be of any suitable shape without departing from the scope of the present disclosure.

Such changes and modifications are to be understood as being within the scope of the present invention as defined by the appended claims.

What is claimed is:

1. A vane pump comprising:

a motor having a mounting portion;

a rotor having a plurality of vanes, the rotor being rotated by the motor;

a first casing having a pump chamber accommodating the rotor to be rotatable, the pump chamber having an inner circumference wall on which the vane slides to suck and discharge a fluid, and a first flat part located in a periphery of an opening of the pump chamber;

a second casing having a second flat part joined to the first flat part to gas-tightly or liquid-tightly close the opening of the pump chamber to define the pump chamber;

an elastic sheet disposed between the second casing and the mounting portion of the motor; and a screw penetrating a first through hole of the first casing, a second through hole of the second casing and a third through hole of the elastic sheet, wherein the screw is configured to fasten and join the first casing, the second casing and the elastic sheet to the mounting portion of the motor, wherein the second casing further includes a protrusion protruding toward the motor, the protrusion is in contact with the mounting portion of the motor, and the protrusion has a protruding dimension smaller than a thickness of the elastic sheet.

2. The vane pump according to claim 1, wherein the elastic sheet has a shape corresponding to a shape of the first flat part of the first casing.

3. The vane pump according to claim 1, wherein the protrusion of the second casing has the second through hole therein.

4. The vane pump according to claim 1, wherein the first flat part of the first casing has the first thorough hole, and the second flat part of the second casing has the second through hole.

5. A vapor leakage check system comprising the vane pump according to claim 1, the fluid is fuel from a fuel tank, wherein the vane pump is configured to depressurize or pressurize an interior of the fuel tank so as to check leakage of vapor of the fuel from the fuel tank.

* * * * *